US008286306B2

(12) United States Patent
Vanini

(10) Patent No.: US 8,286,306 B2
(45) Date of Patent: Oct. 16, 2012

(54) HINGE FOR WINGS OR DOORS

(75) Inventor: Angelo Vanini, Bologna (IT)

(73) Assignee: NUOVA STAR S.p.A. (IT)

( * ) Notice: Subject to any disclaimer, the term of this patent is extended or adjusted under 35 U.S.C. 154(b) by 284 days.

(21) Appl. No.: 12/729,796

(22) Filed: Mar. 23, 2010

(65) Prior Publication Data

US 2010/0257698 A1 Oct. 14, 2010

(30) Foreign Application Priority Data

Apr. 8, 2009 (IT) ..... BO2009A0226

(51) Int. Cl.
*E05F 1/08* (2006.01)

(52) U.S. Cl. ..... 16/290; 16/286; 16/65; 16/80; 49/386; 126/191; 126/194

(58) Field of Classification Search ..... 16/290, 16/286, 289, 233, 271, 297, 335, 336, DIG. 7, 16/65, 50, 80, 72; 49/386–387; 126/191, 126/192, 194
See application file for complete search history.

(56) References Cited

U.S. PATENT DOCUMENTS

| | | | | |
|---|---|---|---|---|
| 3,677,259 | A * | 7/1972 | Doner | 126/194 |
| 3,712,287 | A * | 1/1973 | Summers, Jr. | 126/191 |
| 3,749,080 | A * | 7/1973 | Kleinhenn | 126/191 |
| 4,658,473 | A * | 4/1987 | Schema | 16/290 |
| 5,025,776 | A * | 6/1991 | Hanley et al. | 126/194 |
| 6,397,836 | B1 * | 6/2002 | Pelletier et al. | 126/194 |
| 7,610,656 | B2 * | 11/2009 | Vanini | 16/286 |
| 7,676,888 | B2 * | 3/2010 | Vanini | 16/286 |
| 7,765,643 | B2 * | 8/2010 | Vanini | 16/286 |
| 2003/0172920 | A1 * | 9/2003 | Gronbach | 126/197 |
| 2006/0032019 | A1 * | 2/2006 | Kistner et al. | 16/286 |

FOREIGN PATENT DOCUMENTS

| | | |
|---|---|---|
| DE | 10107138 | 8/2002 |
| DE | 102005002822 | 8/2006 |
| EP | 0632180 | 1/1995 |
| EP | 1961901 | 8/2008 |

OTHER PUBLICATIONS

Italian Search Report dated Nov. 19, 2009 from corresponding Italian application.

* cited by examiner

*Primary Examiner* — William L. Miller
(74) *Attorney, Agent, or Firm* — Timothy J. Kilma; Shuttleworth & Ingersoll, PLC

(57) ABSTRACT

Described is a hinge for wings or doors, in particular for electrical household appliances, comprising a first body (5), a second body (6) and a connecting lever (7) between the first and the second body (5, 6).

14 Claims, 6 Drawing Sheets

61
62
12
13
6
11
R
16
4'
L
L'
L"
7
10
A
45°
88°
63

HINGE FOR WINGS OR DOORS

This application claims priority to Italian Patent Application BO2009A000226 filed Apr. 8, 2009, the entirety of which is incorporated by reference herein.

FIELD OF THE INVENTION

This invention relates to a hinge for wings or doors.

The use of a hinge according to the invention is particularly advantageous for connecting the door of an electrical household appliance to the respective mounting frame.

This specification describes the present invention with reference to an oven purely by way of a non-limiting example.

BACKGROUND OF THE INVENTION

In prior art ovens, when the oven door is opened by rotating it away from the closed position, the door may interfere with one of the lateral uprights of the oven because its axis of rotation cannot physically be located at the absolute end of the door.

In effect, the mere fact of locating the pivot axis even just a few millimeters above the lower end of the door means that opening the door by rotating it about its pivot axis causes a part of the door itself to move into the interior of the oven.

The ends of the uprights are therefore cut to allow the door to be opened without causing the lower portion of it to interfere with the uprights.

These cuts, besides not being visually pleasing when the door is open, provides a repository for dirt or pieces of food, which may accidentally fall into the oven structure, and may also be dangerous as they are made by shearing often relatively thin metal sheets.

In the prior art hinges with two arms are known which tackle and partly overcome this shortcoming.

Prior art hinges with two arms, although they solve the above mentioned problem, are not free of disadvantages, particularly as regards compliance with basic safety standards.

Indeed, besides the complexity due to the presence of the two arms, the arms themselves constitute a serious danger for users during operation of the hinge because of the risk of squashing their fingers between the two hinge arms when opening the door. For this reason, hinges with two arms have in practice been phased out of the market.

SUMMARY OF THE INVENTION

The aim of this invention is to provide a hinge for wings or doors which is free of the above mentioned disadvantages of the prior art.

The technical features of the invention, with reference to the above aim, can be easily inferred from the description below.

BRIEF DESCRIPTION OF THE DRAWINGS

The advantages of the invention are apparent from the detailed description which follows, with reference to the accompanying drawings which illustrate a preferred embodiment of the invention provided merely by way of example and without restricting the scope of the inventive concept, and in which.

DESCRIPTION OF THE PREFERRED EMBODIMENTS

Figure 1:
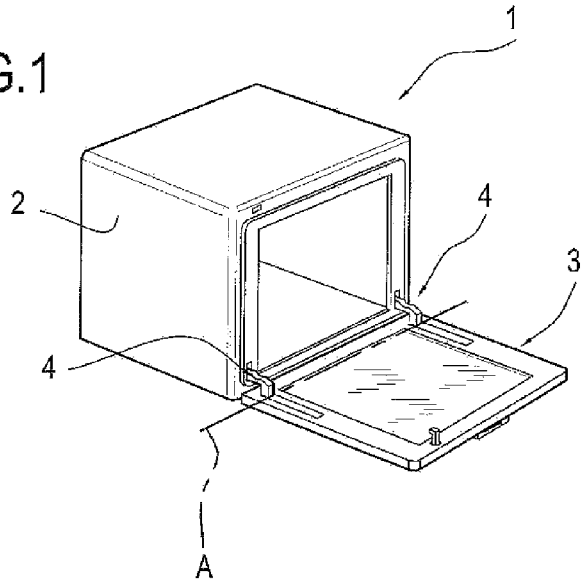
FIG. 1 is a schematic perspective view from above of an oven equipped with door connected to it by means of two hinges made according to this invention.

With reference to FIG. 1, the numeral 1 denotes in its entirety an oven comprising a frame 2 to which a door 3 is connected by two hinges 4 which enable it to rotate in tilting fashion about a first horizontal axis A.

Figure 5:
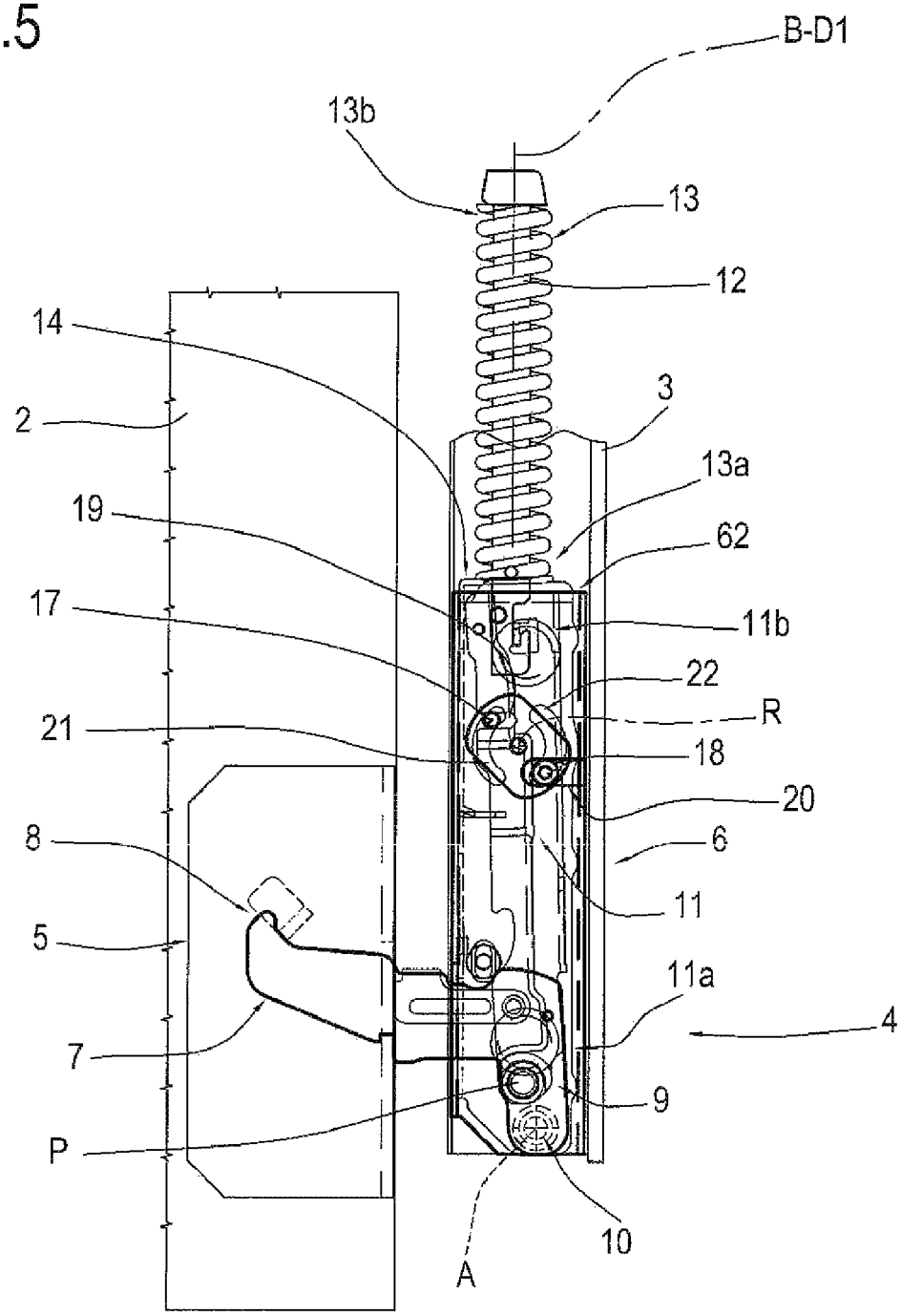
FIGS. 5 to 7 are schematic side elevation views, with some parts transparent, showing the hinge of the figures listed above in three different use configurations.

As shown in FIG. 5, each of the two hinges 4 comprises a first body 5 fixed to the frame 2 of the oven 1, and a second body 6, fixed to the door 3. The first and the second body 5 and 6 are kinematically connected by a connecting lever 7.

Figure 4:
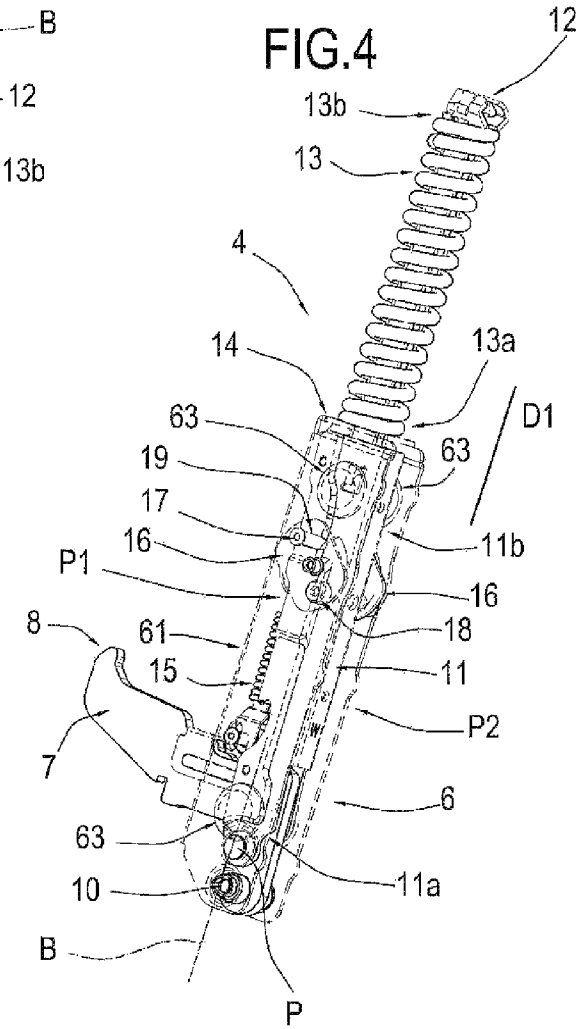
FIG. 4 illustrates the hinge of FIG. 2 with some parts cut away and/or transparent in order to better illustrate others.
Figure 3:
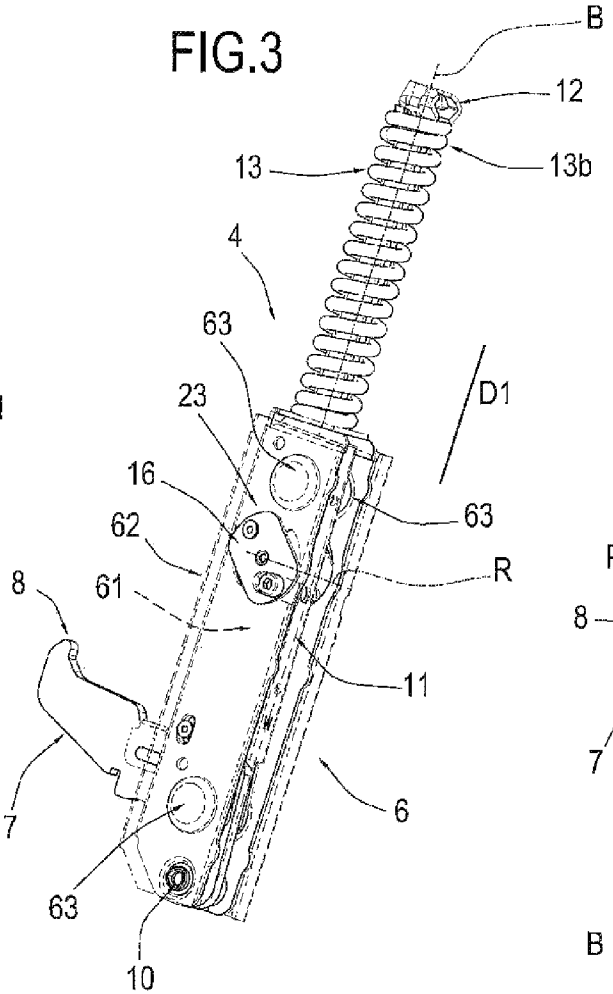
FIG. 3 illustrates the hinge of FIG. 2 with some parts transparent in order to better illustrate others.
Figure 2:
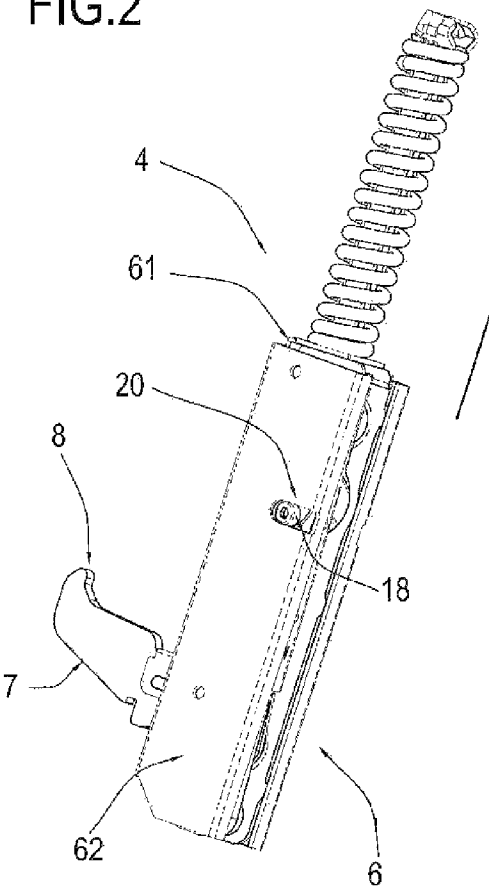
FIG. 2 is a schematic perspective view of a first preferred embodiment of a hinge for wings or doors according to this invention.

With reference also to FIGS. 2 to 4, the second body 6 comprises a first internal box-shaped element 61 and a second external box-shaped element 62 located outside the first element and movable relative to the latter, as described in more detail below.

As shown in FIG. 4, the first internal box-shaped element 61 has a substantially C-shaped transversal cross section and extends longitudinally along an axis B.

The second external box-shaped element 62 also has a substantially C-shaped transversal cross section and extends longitudinally along the axis B, in practice surrounding the first element 61. Spacing means are interposed between the elements 61 and 62 to allow them to slide correctly relative to each other according to a predetermined direction D1 parallel to the axis B. With reference to FIGS. 3 and 4, the spacing means preferably comprise a plurality of protruding buttons 63 made by plastic deformation of the metal sheet of one or the other of the box-shaped elements 61, 62. In the hinges illustrated in the accompanying drawings, the buttons 63 are made on the first element 61 and protrude towards the second box-shaped element 62.

With reference to the embodiment of FIGS. 8 to 11 described below, FIG. 11 clearly illustrates the position of said buttons 63.

Again with reference to FIGS. 2 to 4, the connecting lever 7 comprises a first arm 8, designed to be rigidly connected to the first body 5, and a second arm 9 connected to the second body 6.

For connecting the second arm 9 to the second body 6, the hinge 1 comprises a first pin 10 passing through a respective hole made at the end of the second arm 9 and coaxial with the axis A.

As illustrated in FIGS. 4 to 7, the hinge 4 also comprises a rod 11 and a stem 12 located one after the other longitudinally along the axis B, inside the first box-shaped element 61 and hooked to each other.

Advantageously, the rod 11 is also box shaped, with a C-shaped cross section, and has a lower end 11*a* pivoted to the lever 7 at a respective pin P, in substantially known manner, and an upper end 11*b* for connection to the stem 12.

The second body 6 mounts a first helical spring 13, fitted round the outside of the stem 12 and stressed by compression.

The first box-shaped element 61 comprises an upper wall 14 at right angles to the axis B and having a hole for the passage of the stem 12. The upper wall 14 forms an abutment surface for a proximal end coil 13*a* of the spring 13.

The stem 12 has an upper end longitudinally opposite the one hooked to the rod 11, the upper end being designed to engage a distal end coil 13*b* in such a way as to compress the spring 13.

The spring 13 constitutes for the hinge 4 an elastic element designed to generate a reaction force that opposes the opening of the door 3.

Added to the elastic action of the spring 13, in a substantially known manner not further described, is the action of a second, pre-compressed helical spring 15, shown in FIG. 4.

Pivoting on the opposite side walls of the first box-shaped element 61, labeled P1 and P2 in FIG. 4, are two rotating rocker elements 16 designed to rotate about a respective axis R transversal of the longitudinal axis B of extension of the box-shaped elements 61, 62.

As clearly illustrated in FIGS. 2 to 4, each rotating element 16 has, at opposite ends of it, two pins 17, 18 protruding from opposite faces of the element 16 itself.

In other words, a first pin 17 extends towards the inside of the first box-shaped element 61 in order to engage a respective slot 19 made in the rod 11.

A second pin 18, on the other hand, extends in the opposite direction to the first, that is to say, towards the outside of the first box-shaped element 61 in order to engage a respective slot 20 made in the box-shaped element 62, as shown in FIG. 2.

Figure 6:
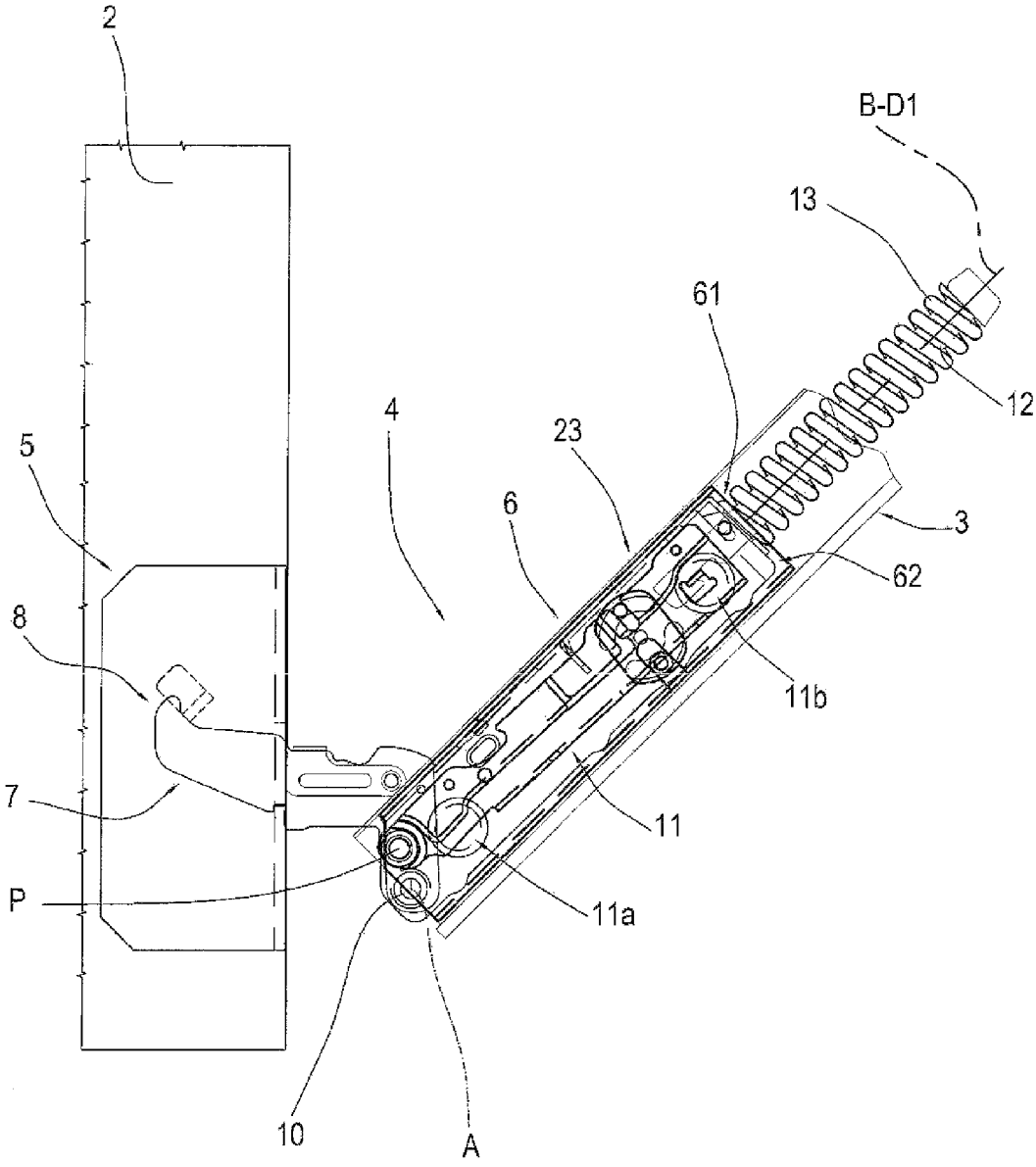
Figure 7:
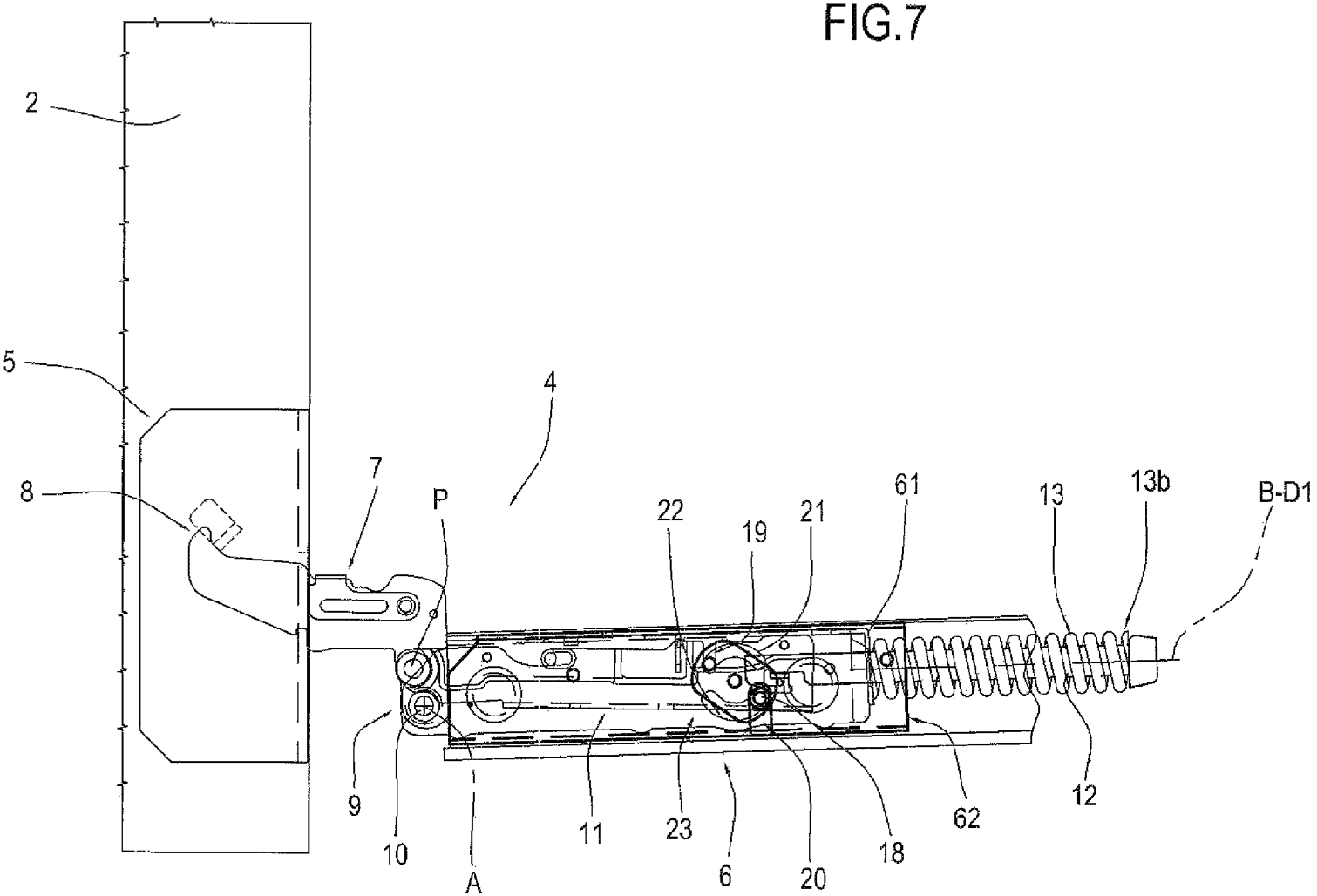

As clearly illustrated in FIGS. 5 to 7, respective curved slots 21, 22 are made on the side walls P1, P2 of the first box-shaped element 61 to allow each rotating rocker element 16 to rotate. More specifically, the slot 21 made on each wall P1, P2 of the first element 61 must allow the pin 17 to go right through the thickness of the wall P1, P2 itself to engage the respective slot 19 made in the underlying rod 11.

In use, as shown by way of example in FIGS. 5 to 7 which illustrate a sequence of opening the door 3, the rotation of the second body 6 in tilting fashion about the axis A relative to the first body 5 causes, in known manner, a movement of the rod 11 and of the first box-shaped element 61 relative to each other.

Since the first pin 17 is engaged inside the slot 19, the movement of the rod 11 relative to the box-shaped element 61 causes the rocker elements 16 to rotate about their axis R.

During this rotation, however, the second pin 18, which is engaged in the respective slot 20 made in the second box-shaped element 62, pushes the latter and causes it to move relative to the first box-shaped element 61.

In other words, the rotation of the rotary rocker element 16 causes relative sliding between the first box-shaped element 61 and the second box-shaped element 62 in the above mentioned direction D1.

When opened, the door 3, which is fixed stably to the second box-shaped element 62, does not interfere with any part that is integral with the frame 2 because the sliding of the elements 61 and 62 relative to each other causes it to move away from the frame 2, as clearly shown in FIGS. 5 to 7.

The rotary rocker elements 16, the pins 17, 18 and the respective slots 19, 20 together form actuator means 23 for imparting the relative sliding movement to the first and second box-shaped elements 61, 62.

Advantageously, by varying the distance of the pins 17, 18 from the pivot axis R of the rocker elements 16, it is possible to modify the extent of the relative sliding movement between the two box-shaped elements 61, 62 and also the effort the user is required to exert to obtain this movement.

In alternative embodiments not illustrated, the rotary rocker elements 16 may for this purpose have different alternative positions for the pins 17, 18 or even pins which are adjustable in position.

FIGS. 8 to 11 illustrate another embodiment 4' of the hinge 4 described above, where unlike the latter, the body 6 is housed inside the frame 2 and the connecting lever 7 is instead designed to engage a door not illustrated.

The operating principle of the hinge 4' does not substantially differ from the one described above with reference to the hinge 4, since it too involves the sliding of the two box-shaped elements 61, 62 relative to each other in order to move the door 3 away from the frame 2 of the oven 1 during opening of the door 3.

Figures 8, 9, 10, 11:
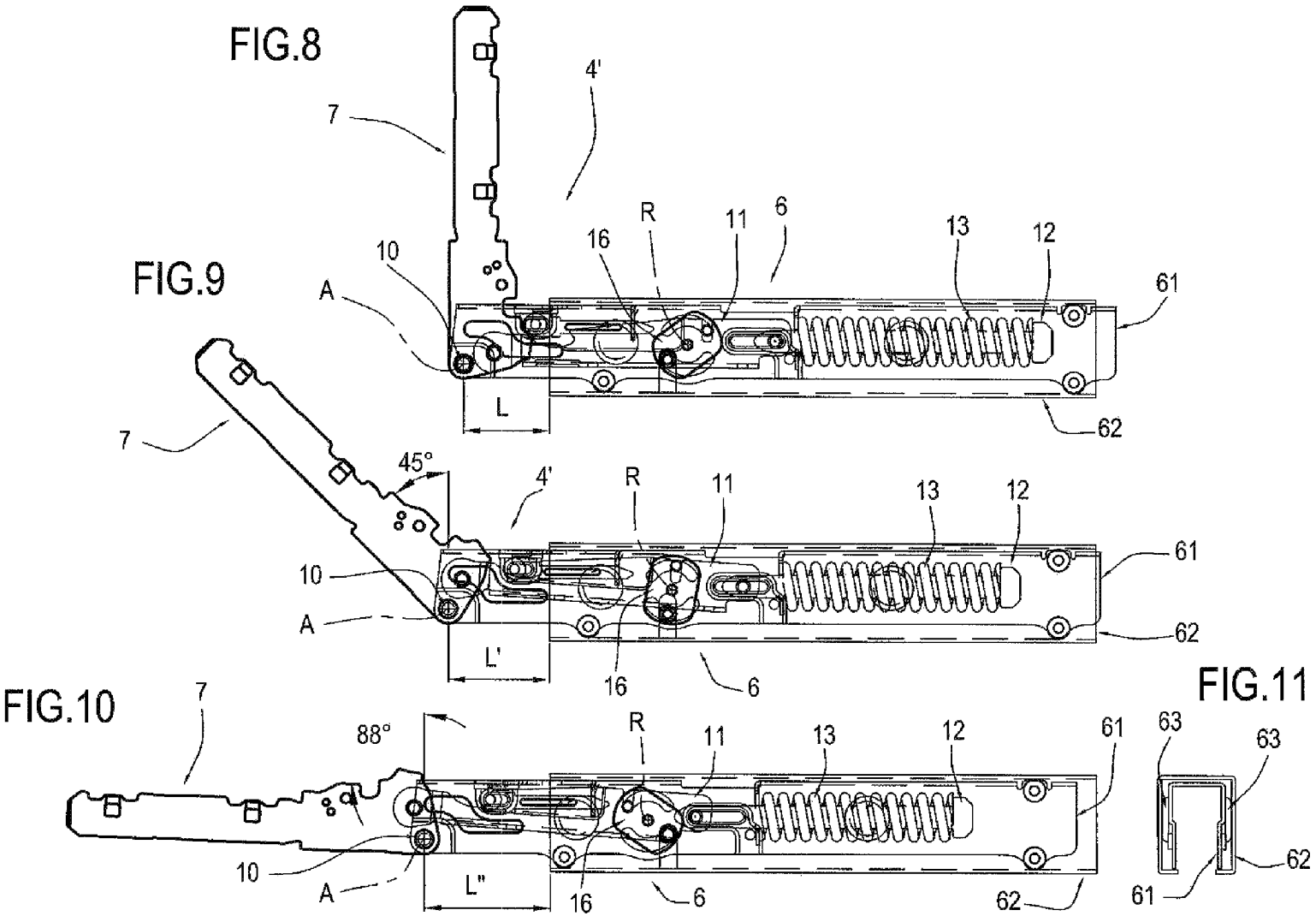
FIGS. 8 to 10 are schematic side elevation views, with some parts transparent, showing another embodiment of the hinge of the figures listed above in three different use configurations.
FIG. 11 is a schematic front elevation view of the hinge of FIG. 10 with some parts cut away for clarity.

FIGS. 8 to 10 illustrate an example embodiment of the hinge 4' in three different configurations of it: in the first, shown in FIG. 8, the door is closed; in the second, shown in FIG. 9, the door is half open; and in the third, shown in FIG. 10, the door is open.

It may be immediately inferred from these drawings that the effect obtained with this invention is precisely that of moving the part of the hinge that is integral with the door (in this case, the lever 7) away from the part of the hinge that is integral with the frame (in this case, the body 6).

With reference to FIG. 8, when the door is in the closed configuration, the distance between the distal end of the second box-shaped element 62—integral with the frame—and the axis A of the pin 10 about which the lever 7 and the door, not illustrated, integral with it rotate, is minimal and represented by the measurement L.

When the lever 7 has rotated in the opening direction, for example through 45°, the box-shaped elements 61, 62 have already been made to slide relative to each other by the actuating means 23, thereby increasing the above mentioned distance to a value L' greater than L.

Lastly, when the door has reached its fully open position and the lever 7 has been rotated through 88° from its initial configuration shown in FIG. 8, the distance between the axis A and the end of the second box-shaped element 62 is at its largest and equal to a value L", greater than L'.

In an experimental non-limiting example version of the hinge 4', illustrated in FIGS. 8 to 11, the distances L, L' e L" measure 16, 19 and 23 millimetres, respectively.

Figure 12:
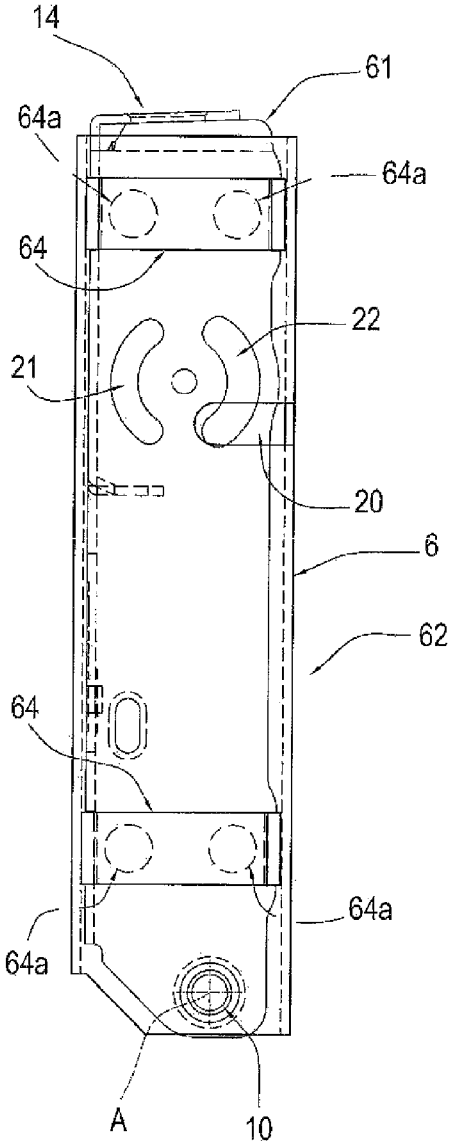
FIGS. 12 and 13 illustrate another embodiment of a detail of the hinge of the figures listed above.
Figure 13:
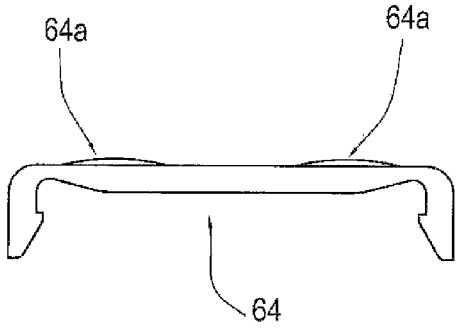

FIGS. 12 and 13 illustrate an alternative embodiment of the spacing means between the elements 61, 62 instead of the buttons 63 described above and illustrated in FIGS. 3 to 11. As illustrated in FIGS. 12 and 13, the spacing means comprise a plurality of removable shoes 64, advantageously made of a material with a low friction coefficient, such as Teflon®, for example.

The shoes 64 are hooked to the first box-shaped element 61 at its opposite longitudinal ends, there being two for each side wall P1, P2.

Each shoe 64 has two respective convex portions 64*a*, protruding towards the second box-shaped element 62, in such a way as to space the box-shaped elements 61, 62 from each other and, thanks also to the low-friction material they are made of, to facilitate their relative sliding movement.

The invention described has evident industrial applications and can be modified and adapted in several ways without thereby departing from the scope of the inventive concept. Moreover, all details of the invention may be substituted by technically equivalent elements.

The invention claimed is:

1. A hinge for a door of a household appliance, comprising:

a first body, a second body having a pivot pin with an axis, and a connecting lever between the bodies; the lever pivoting on the second body via the pivot pin about the axis and having a first portion integral with the first body for making the first and second bodies movable relative to one another with a tilting action;

one of the first and second bodies being fixable to a frame and the other to the door, for moving the door relative to the frame between a closed position and an open position;

the second body comprising:

a first substantially box-shaped element containing an elastic mechanism interposed between the second body and the lever for applying an elastic action on the lever;

a second box-shaped element positioned outside the first box-shaped element and slidably mobile relative to the first box-shaped element; and an actuator mechanism for imparting a relative sliding movement to the first and second box-shaped elements;

wherein, the sliding movement of the first and second box-shaped elements relative to each other causes the first body to move away relative to the second body from a first position to a second position so that a distance between a distal end of the second box-shaped element and the axis of the pivot pin, about which the lever rotates, varies between a minimal value, in the first position, to a maximum value, in the second position.

2. The hinge according to claim 1, wherein the actuator mechanism comprises at least one rotating element pivoting on the first box-shaped element.

3. The hinge according to claim 2, wherein the rotating element comprises a first pin engaging a rod for driving the elastic mechanism and a second pin for engaging the second box-shaped element.

4. The hinge according to claim 1, wherein the second box-shaped element is integrated in the door.

5. The hinge according to claim 1, comprising at least one spacer element for the box-shaped elements.

6. The hinge according to claim 5, wherein the at least one spacer element is integrated in one of the box-shaped elements.

7. The hinge according to claim 5, wherein the at least one spacer element is removable and made of material with a low coefficient of friction.

8. The hinge according to claim 1, and further comprising the household appliance, the hinge being attached to the household appliance.

9. A hinge for a door of a household appliance, comprising:

a first body, a second body having a pivot pin, and a connecting lever between the bodies; the lever pivoting on the second body via the pivot pin and having a first portion integral with the first body for making the first and second bodies movable relative to one another with a tilting action;

one of the first and second bodies being fixable to a frame and the other to the door, for moving the door relative to the frame between a closed position and an open position;

the second body comprising:

a first substantially box-shaped element containing an elastic mechanism interposed between the second body and the lever for applying an elastic action on the lever;

a second box-shaped element positioned outside the first box-shaped element and slidably mobile relative to the first box-shaped element; and an actuator mechanism for imparting a relative sliding movement to the first and second box-shaped elements;

wherein the actuator mechanism comprises at least one rotating element pivoting on the first box-shaped element;

wherein the rotating element comprises a first pin engaging a rod for driving the elastic mechanism and a second pin for engaging the second box-shaped element.

10. The hinge according to claim 9, wherein the second box-shaped element is integrated in the door.

11. The hinge according to claim 9, comprising at least one spacer element for the box-shaped elements.

12. The hinge according to claim 11, wherein the at least one spacer element is integrated in one of the box-shaped elements.

13. The hinge according to claim 11, wherein the at least one spacer element is removable and made of material with a low coefficient of friction.

14. The hinge according to claim 9, and further comprising the household appliance, the hinge being attached to the household appliance.

* * * * *